US008327616B2

(12) United States Patent
Böttcher et al.

(10) Patent No.: US 8,327,616 B2
(45) Date of Patent: Dec. 11, 2012

(54) BURNER HAVING A PROTECTIVE ELEMENT FOR IGNITION ELECTRODES

(75) Inventors: Andreas Böttcher, Ratingen (DE); Andre Kluge, Dülmen (DE); Claus Krusch, Mülheim an der Ruhr (DE); Elmar Pfeiffer, Heinsberg (DE); Sabine Tüschen, Oberhausen (DE)

(73) Assignee: Siemens Aktiengesellschaft, München (DE)

( * ) Notice: Subject to any disclaimer, the term of this patent is extended or adjusted under 35 U.S.C. 154(b) by 566 days.

(21) Appl. No.: 12/310,284

(22) PCT Filed: Aug. 14, 2007

(86) PCT No.: PCT/EP2007/058411

§ 371 (c)(1),
(2), (4) Date: Feb. 19, 2009

(87) PCT Pub. No.: WO2008/022948

PCT Pub. Date: Feb. 28, 2008

(65) Prior Publication Data

US 2011/0120077 A1 May 26, 2011

(30) Foreign Application Priority Data

Aug. 23, 2006 (EP) ..... 06017534

(51) Int. Cl.
*F02C 7/266* (2006.01)

(52) U.S. Cl. ..... 60/39.827; 60/752; 60/39.821

(58) Field of Classification Search ..... 60/39.287, 60/39.821, 39.827; 431/258, 263–264, 191–194
See application file for complete search history.

(56) References Cited

U.S. PATENT DOCUMENTS

| | | | | |
|---|---|---|---|---|
| 2,850,084 | A | 9/1958 | Kunzler | |
| 3,558,251 | A | 1/1971 | Bauger et al. | |
| 3,823,345 | A | 7/1974 | Mitts et al. | |
| 4,029,936 | A | 6/1977 | Schweitzer | |
| 4,740,156 | A * | 4/1988 | Beck et al. | 431/265 |
| 4,903,476 | A | 2/1990 | Steber et al. | |
| 5,393,224 | A * | 2/1995 | Allen et al. | 431/266 |
| 5,856,651 | A | 1/1999 | Shaffer | |
| 5,860,804 | A | 1/1999 | Nachaj | |
| 6,777,650 | B1 | 8/2004 | Hamel | |

FOREIGN PATENT DOCUMENTS

| | | |
|---|---|---|
| EP | 0193838 A3 | 9/1986 |
| EP | 1591723 A2 | 11/2005 |
| SU | 235896 | 7/1967 |

OTHER PUBLICATIONS

English Translation of SU 235896.

* cited by examiner

*Primary Examiner* — William H Rodriguez
*Assistant Examiner* — Craig Kim

(57) ABSTRACT

A gas turbine burner with an igniter and an ignition electrode for installation in a main burner of a gas turbine is disclosed. The ignition electrode is protected from damage by a protective element.

16 Claims, 3 Drawing Sheets

BURNER HAVING A PROTECTIVE ELEMENT FOR IGNITION ELECTRODES

CROSS REFERENCE TO RELATED APPLICATIONS

This application is the US National Stage of International Application No. PCT/EP2007/058411 filed Aug. 14, 2007 and claims the benefit thereof. The International Application claims the benefits of European Patent application No. 06017534.6 EP filed Aug. 23, 2006, both of the applications are incorporated by reference herein in their entirety.

FIELD OF INVENTION

The invention relates to a burner having an igniter and at least one ignition electrode, in particular an ignition electrode of a type suitable for installation in a burner of a gas turbine.

BACKGROUND OF INVENTION

A burner embodied as a pilot burner having an igniter and ignition electrodes leading to the igniter is described in EP 0 193 838 B1, for example. The igniter has the task of igniting the fuel. The ignition electrodes are fixed on the exterior of the pilot burner and run parallel to its longitudinal axis. The fuel supply is located in the interior of the pilot burner and ends in fuel outlet openings. The ignition electrodes end in the area of the fuel outlet openings and ignite the fuel exiting there by means of an ignition spark. The ignition spark is generated by means of an ignition voltage applied between two ignition electrodes and is present for the entire duration of the ignition.

If one or both of the ignition electrodes mounted on the pilot burner are damaged or bent during transportation or installation, this can have a negative effect on the operational reliability of the ignition electrodes. Damage or bending can therefore make it become necessary to replace the ignition electrodes.

Replacing the ignition electrodes can also become necessary if one of the electrodes is bent to such an extent that a current sparkover occurs between an electrode lead and another metallic component instead of between the electrode tips and consequently the gas mixture cannot be ignited.

U.S. Pat. Nos. 2,850,084, 5,860,804 and 5,865,651 essentially disclose igniters having ignition electrodes in which the ignition is brought about by the heating of an ignition electrode as a consequence of its high resistance, which is to say thermally. This form of ignition is referred to in the following as thermal ignition. The possibility of an electronic or electric ignition, by sparkover for example, is mentioned only in U.S. Pat. No. 5,860,804.

Various protective elements or protective enclosures for protecting the ignition electrode area in proximity to which the ignition takes place are disclosed in U.S. Pat. Nos. 2,850,084, 5,860,804 and 5,865,651. Said protective enclosures are characterized in that they can extend into the resulting flame and are intended to protect the ignition electrodes in the ignition zone in particular against possible soiling or damage. In this arrangement the areas of the ignition electrodes which are adjacent to the ignition zone, i.e. which lead to or away from the ignition zone, are not protected by a corresponding protective element.

Igniters having ignition electrodes are also described in U.S. Pat. Nos. 4,029,936, 6,777,650 B1 and 3,823,345. In these, at least areas of the ignition electrodes which are adjacent to the ignition zone, i.e. which lead to or away from the ignition zone, are also enclosed, at any rate partially, by a housing. However, these igniters are exclusively thermal igniters. Furthermore, these igniters are not igniters for gas turbine burners. No gas turbine burners are in fact disclosed in U.S. Pat. Nos. 2,850,084, 5,860,804, 5,865,651, 4,029,936, 6,777,650 B1 and 3,823,345. However, the ignition electrodes that are used in the context of gas turbine burners and ignite with the aid of an ignition spark are adversely affected considerably more easily in their operational reliability by comparison with ignition electrodes of thermal igniters.

SUMMARY OF INVENTION

An object of the invention is to provide a gas turbine burner having at least one ignition electrode, wherein the aforementioned problems do not occur or occur only to a reduced extent. A further object of the present invention is to provide a gas turbine having an advantageous gas turbine burner.

This object is achieved by a gas turbine burner and a gas turbine as claimed in the independent claims. The gas turbine burner is embodied in particular as a pilot burner.

The achievement of the object according to the invention consists in the burner being equipped with at least one ignition electrode running on its exterior, said electrode being assigned a protective element which projects beyond the exterior of the burner and beyond the ignition electrode. The gas turbine according to the invention is equipped with a gas turbine burner of said kind.

The advantage of the solution lies in the fact that the ignition electrodes are protected and consequently damage during transportation or, as the case may be, during the installation and removal of the ignition electrodes can be avoided. Although a combustion chamber of a gas turbine having a burner is described in EP 0 193 838 B1, the ignition electrodes of the burner are not equipped with a protective element.

Advantageous developments are specified in the dependent claims.

In one advantageous development the protective element is connected to the exterior of the burner such that the necessary stability is ensured.

Another advantageous development consists in the protective element surrounding the ignition electrodes, the ignition electrode being at least partially covered lengthwise such that the at least one ignition electrode is optimally protected.

The protective element can also be embodied as U-shaped and be secured with the open side on the exterior of the burner, such that the ignition electrode is protected toward the exterior on three sides. The protective element can completely enclose the electrodes at least in the front area close to the electrode tips.

Alternatively the protective element can be formed by means of at least one rib such that a better accessibility of the ignition electrodes is ensured. The rib can run parallel to the ignition electrode. At least one rib can also be disposed on each of the two sides of the ignition electrode.

The protective element is preferably manufactured from a flexurally resistant and shockproof material such that a deformation of the protective element that could lead to a deformation of the internal ignition electrodes is avoided.

A further advantageous development consists in the distance between the protective element and the ignition electrode being at least sufficiently great such that no sparkover occurs between the protective element and the ignition electrode when an ignition voltage is applied to the ignition electrode, thereby ensuring that a current sparkover between the ignition electrode and the protective element can be reliably avoided.

Moreover, the gas turbine burner can include two ignition electrodes each having an electrode tip. In this case the ignition takes place by means of a sparkover at the electrode tips when an ignition voltage is applied between the two ignition electrodes. The ignition is therefore effected non-thermally. Although igniters other than thermal igniters are also mentioned generally in U.S. Pat. Nos. 5,860,804 and 5,865,651, there is no description in these documents of an igniter in which a sparkover takes place between two electrodes. The other already cited documents describe only thermal igniters.

The protective element is preferably assigned to an area of the ignition electrode which leads to the electrode tip. That is to say that in this case the protective element does not extend as far as the electrode tip and also does not protrude beyond the electrode tip. Rather, the intention is to protect the area of the electrode which runs along the exterior of the gas turbine burner, in other words, therefore, the supply line to the actual ignition zone at the electrode tip.

In addition, the gas turbine burner is basically rotationally symmetrical and the at least one ignition electrode running on its exterior can extend parallel to the axis of symmetry of the gas turbine burner.

The gas turbine is equipped with a gas turbine burner in one of the embodiment variants described.

BRIEF DESCRIPTION OF THE DRAWINGS

Further features, characteristics and advantages of the invention will emerge from the following description of exemplary embodiments with reference to the accompanying figures, in which.

DETAILED DESCRIPTION OF INVENTION

Figure 1:
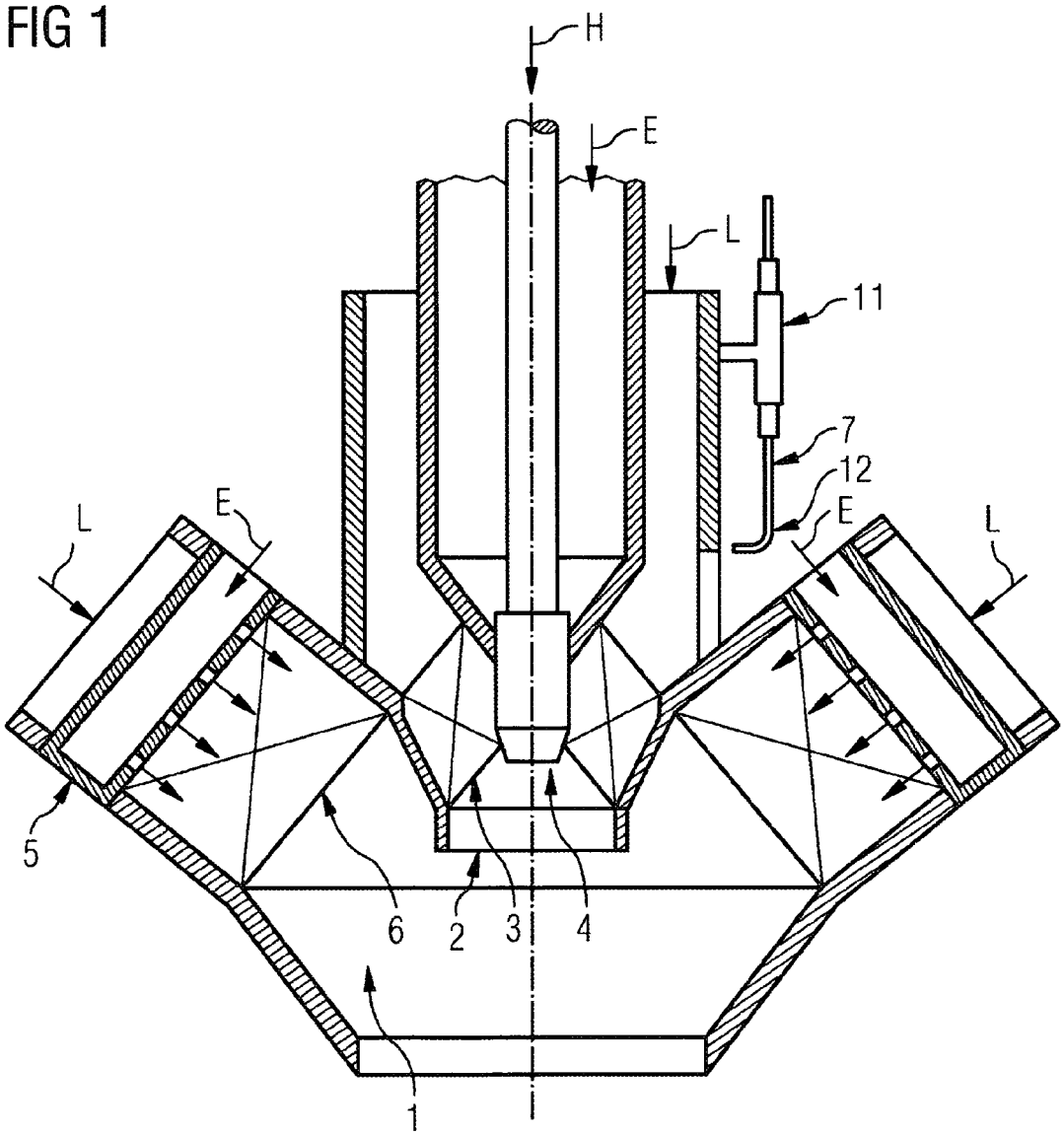
FIG. 1 shows a burner having an ignition electrode.

The burner arrangement shown in FIG. 1 belongs to a gas turbine system, the preferred field of application of the invention. However, the burner arrangement is also suitable for gas-fired combustion systems of boilers.

The burner arrangement consists of at least one first burner 2, which is mounted on a carrier plate (not shown in FIG. 1; see FIG. 2, 3) and serves as a pilot burner, and a second burner 1, which serves as a main burner and in the middle of which the first burner 2 is inserted coaxially. The first burner 2 has a burner head 4 with a swirl vane system 3 and can be operated with natural gas E and/or heating oil H as fuel. The head 4 of the first burner 2 is coaxially (referred to the burner axis) surrounded by an air inlet duct 6 which serves to supply the main part of the combustion air L to a combustion zone (not shown) embodied downstream of the burner head 4. The pressurized combustion air L is supplied to the annular gap by a compressor of the gas turbine system. The hot combustion gases flow into the turbine vane system.

The second burner 1 serving as a main burner is supplemented by the first burner 2 serving as a pilot burner, i.e. in natural gas operation it is possible, once the pilot burner operating mode has been started up and heated, to switch over to the main burner operating mode with its lower NOx values. In this case the first burner 2 serves for stabilizing the flame.

The second burner comprises nozzle jets 5 and an air inlet duct 6. The nozzle jets are connected to a fuel supply system (not shown) and serve for mixing petroleum, natural gas or another gaseous or liquid fuel with the supplied combustion air L. The air inlet duct 6 supplies the combustion air L, possibly admixed with fuel, to the flame zone.

The air-fuel mixture supplied to the first burner 2 is ignited by way of a rod-shaped or tubular electrode arrangement having two ignition electrodes 7. The ignition electrodes 7 run mainly parallel to the axis of the first burner 2. However, the distance of the ignition electrodes 7 from the outer wall of the first burner is considerably greater in the area of the carrier plate 9 through which the ignition electrodes 7 are passed. The distance between the ignition electrodes 7 themselves is also greater in the area of the carrier plate than in the area of the outer wall of the first burner 2. The ignition electrodes are secured on the outside of the first burner 2 by means of connecting pieces 11.

Figure 2:
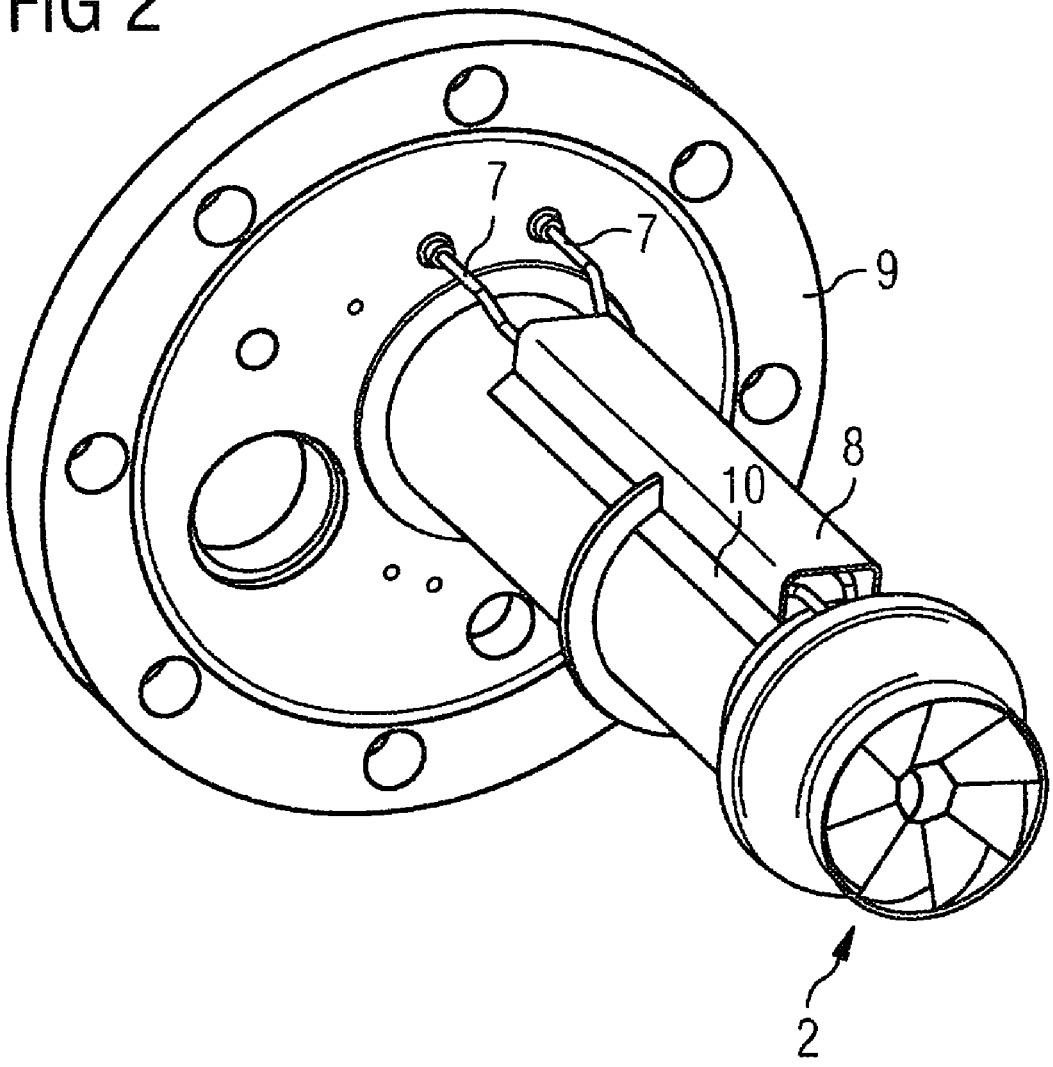
FIG. 2 shows a burner having ignition electrodes and a protective element which has a U-shaped cross-section and encloses the ignition electrodes in the front area.

As an exemplary embodiment of a burner according to the invention, FIG. 2 shows a burner 2 on the outer wall of which are mounted two ignition electrodes 7 miming in the longitudinal direction of the burner 2. The burner 2 can serve in particular as a first burner in the burner arrangement described with reference to FIG. 1.

The ignition electrodes of the burner 2 are covered by means of a protective element 8 which, in the present example, is embodied as a metal plate 8 bent in a U shape. The sides of the metal plate 8 each have an angled area in which they are secured to the outer wall of the burner 2. The fixing 10 is advantageously effected by means of suitable detachable connecting elements, e.g. screws, so that it will be possible to access the ignition electrodes 7 in case of need. Basically, non-detachable connections, welded joints for example, are also possible instead of the detachable connection. The U-shaped metal plate extends at least over the front part of the ignition electrodes 7, i.e. the part that lies close to the electrode tips 12.

The metal plate 8 should be manufactured from a shockproof and flexurally resistant material such as e.g. steel. The distance of the metal plate 8 from the ignition electrodes 7 should be at least sufficiently great such that no sparkover occurs between the protective metal plate 8 and the ignition electrodes 7 when an ignition voltage is applied to the ignition electrodes 7. The actual value for the distance is dependent on the dielectric strength of the medium between the electrodes 7 and the protective metal plate 8 as well as on the geometry of the ignition electrodes and the temperature prevailing when the ignition voltage is applied. In the present exemplary embodiment using air as the medium, a safety clearance of at least 5 mm should be maintained if the ignition voltage amounts to 5 kV.

Figure 3:
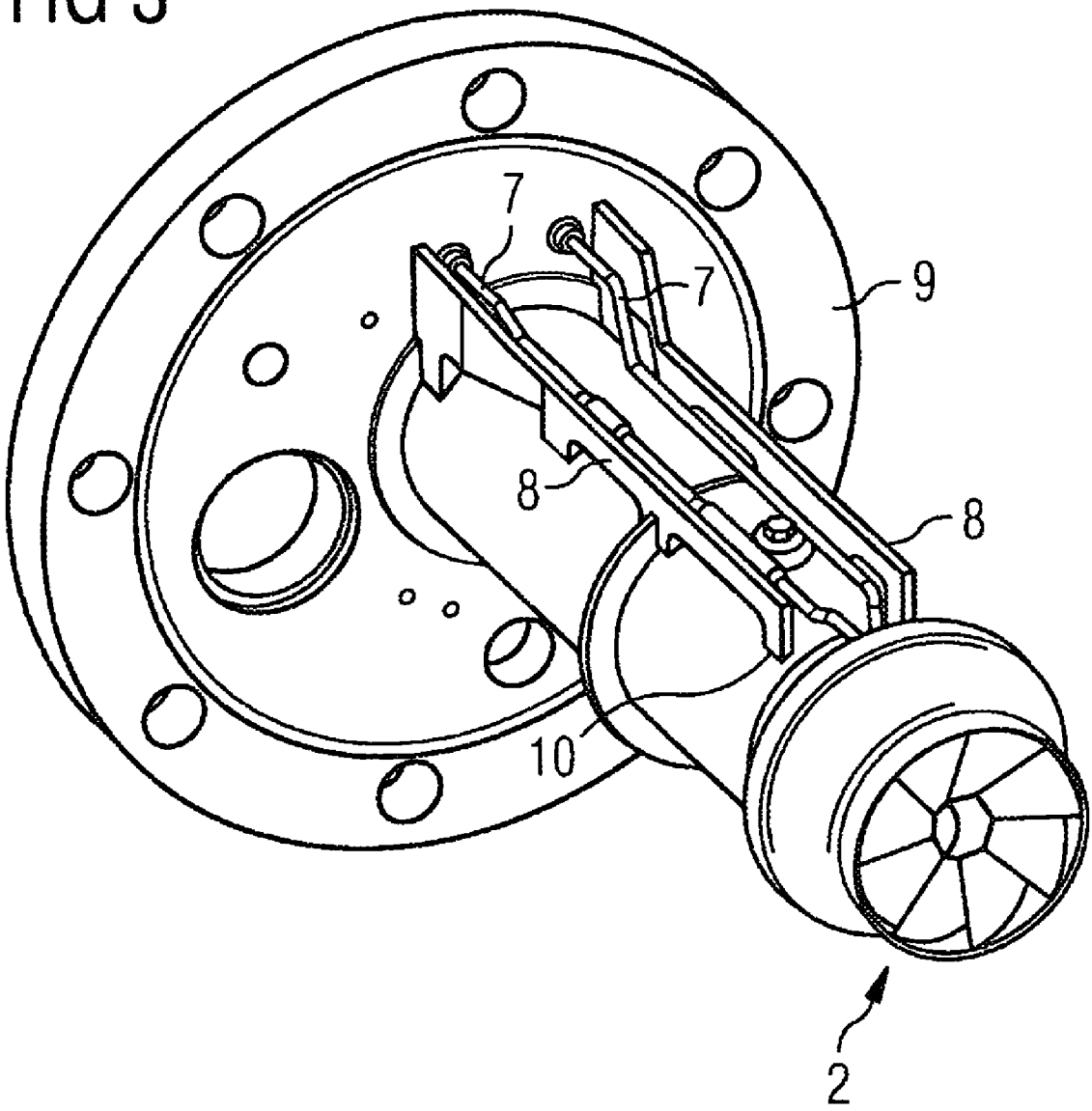
FIG. 3 shows a burner having ignition electrodes and a protective element which is formed from ribs and runs parallel to the ignition electrodes.

FIG. 3 shows a burner 2 having two ignition electrodes 7 mounted on its outer wall. Said burner 2 can also serve in particular as a first burner in the burner arrangement described with reference to FIG. 1.

A longitudinal rib 8 runs in each case to the right and left of the ignition electrodes 7 of the burner 2 shown in FIG. 3. The longitudinal ribs 8 project above the surface of the burner 2 beyond the ignition electrodes 7 such that the ignition electrodes 7 are protected against shocks. The ribs 8 are fixedly connected to the wall of the burner 2. The fixing 10 can be effected by welding or soldering, for example. Although detachable connections between the longitudinal ribs 8 and the burner 2, realized by means of screws for example, are also possible, non-detachable connections are entirely adequate since the arrangement does not significantly restrict access to the ignition electrodes 7 and consequently the ribs 8 do not need to be removed in order to access the electrodes 7.

Like the metal plate of the first exemplary embodiment, the ribs 8 should be manufactured from a shockproof and flexurally resistant material such as e.g. steel. The distance of the ribs from the ignition electrodes 7 should amount to at least 5 mm in the case of an ignition voltage of 5 kV in order to ensure that no current sparkover can take place between an ignition electrode and a rib.

In conclusion let it be noted that independent protection shall be applied, also individually or in any combination, to all features that are cited in the application documents and in particular in the dependent claims, in spite of the formal back-reference made to one or more specific claims.

The invention claimed is:

1. A gas turbine burner, comprising:

two ignition electrodes, each having an electrode tip, wherein a sparkover takes place at the electrode tips when an ignition voltage is applied between the two ignition electrodes, the ignition electrodes running on the burner's exterior; and a protective element spanning an entirety of a protected length of the ignition electrodes, wherein at any given axial location an outward surface of the protective element is characterized by being at a greater distance from a burner longitudinal axis than an axially corresponding portion of the ignition electrodes, and wherein the protective element is supported at least at each end by a portion of the protective element that spans from each end to a respective axially adjacent location on the burner's exterior, wherein the protective element is embodied as U-shaped in cross-section along the entire protected length and is secured with an open side on the exterior of the burner, wherein the protective element extends from a radially outward facing surface of the burner beyond the ignition electrodes, wherein a distance between the protective element and each of the ignition electrodes is at least sufficiently great such that no sparkover takes place between the protective element and either of the ignition electrodes when an ignition voltage is applied to the ignition electrodes, the actual value for the distance being dependent at least on the geometry of the ignition electrodes and the temperature prevailing when the ignition voltage is applied.

2. The gas turbine burner as claimed in claim 1, wherein the protective element surrounds both of the ignition electrodes, the ignition electrodes being at least partially covered lengthwise.

3. The gas turbine burner as claimed in claim 1, wherein the protective element encloses both of the ignition electrodes at least in the front area close to the electrode tips.

4. The gas turbine burner as claimed in claim 1, wherein the protective element includes at least one rib disposed axially adjacent the protected length of the ignition electrodes.

5. The gas turbine burner as claimed in claim 4, wherein the rib extends parallel to the ignition electrodes.

6. The gas turbine burner as claimed in claim 4, wherein at least one rib is disposed on each side of the ignition electrodes.

7. The gas turbine burner as claimed in claim 5, wherein at least one rib is disposed on each side of the ignition electrodes.

8. The gas turbine burner as claimed in claim 1, wherein the protective element is made of a flexurally resistant and shockproof material.

9. The gas turbine burner as claimed in claim 1, wherein the gas turbine burner is a pilot burner for a burner arrangement.

10. The gas turbine burner as claimed in claim 1, wherein the protective element is assigned to an area of the ignition electrode which leads to the electrode tip.

11. A gas turbine, comprising:

a gas turbine burner comprising a burner longitudinal axis and two ignition electrodes, each having an electrode tip, wherein a sparkover takes place at the electrode tips when an ignition voltage is applied between the two ignition electrodes, the ignition electrodes running on the burner's exterior, and a protective element configured to protect a protected length of the ignition electrodes, wherein the protective element is embodied as U-shaped in cross-section along the entire protected length and is secured with an open side on the exterior of the burner, wherein the protective element extends from a radially outward facing surface of the burner to beyond the ignition electrodes, and wherein a distance between the protective element and each of the ignition electrodes is at least sufficiently great such that no sparkover takes place between the protective element and either of the ignition electrodes when an ignition voltage is applied to the ignition electrode, the actual value for the distance being dependent at least on the geometry of the ignition electrodes and the temperature prevailing when the ignition voltage is applied.

12. The gas turbine burner as claimed in claim 11, wherein the protective element surrounds the ignition electrodes, the ignition electrodes being at least partially covered lengthwise.

13. The gas turbine burner as claimed in claim 11, wherein the protective element encloses both of the ignition electrodes at least in the front area close to the electrode tips.

14. A gas turbine burner, comprising:

two ignition electrodes, each having an electrode tip, wherein a sparkover takes place at the electrode tips when an ignition voltage is applied between the two ignition electrodes, the ignition electrodes running on the burner's exterior; and a protective element spanning at least part of a protected length of the ignition electrodes, wherein the protective element is arranged on the burner's exterior, wherein the protective element includes at least one rib axially adjacent the protected length, the rib comprising an outward surface disposed at a greater distance from a burner longitudinal axis than an axially corresponding portion of the ignition electrode, the rib comprising a long axis extending parallel to the ignition electrodes, wherein the protective element is embodied as U-shaped in cross-section along the entire protected length and is secured with an open side on the exterior of the burner, wherein the protective element extends from a radially outward facing surface of the burner beyond the ignition electrodes, wherein a distance between the protective element and each of the ignition electrodes is at least sufficiently great such that no sparkover takes place between the protective element and either of the ignition electrodes when an ignition voltage is applied to the ignition electrodes, the actual value for the distance being dependent at least on the geometry of the ignition electrodes and the temperature prevailing when the ignition voltage is applied.

15. The gas turbine burner as claimed in claim 14, comprising at least two ribs, wherein at least one rib is disposed on each of the two longitudinal sides of the ignition electrodes.

16. The gas turbine burner as claimed in claim 14, wherein the gas turbine burner is rotationally symmetrical around a burner longitudinal axis, which is an axis of symmetry, wherein the ignition electrodes running on its exterior extend parallel to the axis of symmetry of the gas turbine burner.

* * * * *